US006974165B2

(12) United States Patent
Koike et al.

(10) Patent No.: US 6,974,165 B2
(45) Date of Patent: Dec. 13, 2005

(54) DOOR LOCK APPARATUS FOR A VEHICLE

(75) Inventors: Tsuneyuki Koike, Anjo (JP); Toshio Machida, Toyota (JP); Toshitsugu Oda, Okazaki (JP); Shinsuke Takayanagi, Aichi-ken (JP)

(73) Assignees: Aisin Seiki Kabushiki Kaisha, Kariya (JP); Aisin Kiko Co., Ltd., Aichi-Ken (JP)

( * ) Notice: Subject to any disclaimer, the term of this patent is extended or adjusted under 35 U.S.C. 154(b) by 0 days.

(21) Appl. No.: 10/779,851

(22) Filed: Feb. 18, 2004

(65) Prior Publication Data

US 2004/0227356 A1 Nov. 18, 2004

(30) Foreign Application Priority Data

Feb. 18, 2003 (JP) ..... 2003-040000

(51) Int. Cl.[7] ..... E05C 3/06
(52) U.S. Cl. ..... 292/216; 292/201
(58) Field of Search ..... 292/216, 201; 49/279, 280; 70/279.1

(56) References Cited

U.S. PATENT DOCUMENTS

| | | | | |
|---|---|---|---|---|
| 4,762,348 A | | 8/1988 | Matsumoto | |
| 5,667,260 A | * | 9/1997 | Weyerstall | 292/201 |
| 6,032,987 A | * | 3/2000 | Fukumoto et al. | 292/216 |
| 6,154,354 A | * | 11/2000 | Alexanian | 361/160 |
| 6,386,599 B1 | * | 5/2002 | Chevalier | 292/201 |

* cited by examiner

*Primary Examiner*—Gary Estremsky
(74) *Attorney, Agent, or Firm*—Buchanan Ingersoll PC

(57) ABSTRACT

A vehicle door lock apparatus includes a latch, an operating member for performing a lock operation for rotating the latch to a lock position by being moved from a neutral position to a first position and an unlock operation for rotating the latch to an open position by being moved from the neutral position to a second position, a control unit for switching a moving direction of the operating member, an operated member for being operated along with the operating member moved to the second position, a restricting member for restricting a movement of the operated member in a predetermined position, and a detecting means for detecting the operated member being positioned adjacent to the predetermined position. The control unit enters a standby mode through a process of bringing the operating member to return to the first or second position side after the unlock operation or the lock operation is completed.

15 Claims, 12 Drawing Sheets

DOOR LOCK APPARATUS FOR A VEHICLE

This application is based on and claims priority under 35 U.S.C. § 119 with respect to Japanese Application No. 2003-040000 filed on Feb. 18, 2003, the entire contents of which are incorporated herein by reference.

FIELD OF THE INVENTION

The present invention generally relates to a vehicle door lock apparatus.

BACKGROUND OF THE INVENTION

A known door lock apparatus for a vehicle is disclosed in U.S. 4762348. The electric door lock system disclosed in the above patent includes a box-shaped case member to which a rotating plate having a substantially circular shape is supported. The rotating plate can be driven in a clockwise direction and a counterclockwise direction by a motor. An output member having a fan shape is connected to one side face of the rotating plate. When the motor is driven to rotate the rotating plate in the counterclockwise direction by an operation of a relay in response to the operation of the inside switch by the user for opening the door, the output member pulls a rod for opening the door via an arm. Then, a pawl is rotated in a direction in which the engagement between the pawl and a latch is disengaged. The latch is subsequently rotated to an open position of the door and the unlock operation is completed accordingly. Meanwhile, when the motor is driven to rotate the rotating plate in the clockwise direction by operations of a half-latch sensor and a relay in response to the closing operation of the door to the half-latched position, the output member pulls a rod for closing the door via the other arm. Then, the latch is rotated to a full-latched position, and the door lock operation is completed accordingly. A neutral position sensor whose contact is retained in closed state by a circumferential face of the rotating plate is provided in the case member. When a concave portion formed on the other side face of the circumferential face of the rotating plate is moved to a portion where the neutral position sensor is positioned by the rotation of the rotating plate, the contact of the neutral position sensor becomes in the open state. The rotating plate is constituted to return to the neutral position side by the motor so that the rotating plate can start the following lock operation, for example, in case that the unlock operation is performed. When the contact of the neutral position sensor is turned in the open state with the concave portion being positioned at the neutral position sensor, the motor is stopped by the operation of the relay to prepare for the following operation (same return operation is performed in case of the lock operation).

According to the above-mentioned disclosed door lock apparatus, however, the following problems may occur. The motor is stopped based on the switching of the neutral position sensor to the open state when the rotating plate is returned to the neutral position at a time of the completion of the lock operation or the unlock operation. Thus, if the concave portion is set short in length in the circumferential direction of the rotating plate for precisely defining the neutral position, the neutral position sensor tends to be positioned out of the concave portion when the rotating plate overruns with the motor and then the standby state is initiated in that state. In this case, the neutral position sensor is in the closed status even if the door is open. This fails to satisfy the condition that all sensors are in open state under the door being open, which is disclosed in the above Japanese Publication. The lock operation is possibly not performed since the relay is not operated and thus the motor is not supplied with power even if the half-latch sensor becomes in the closed state by the door being closed to the half-latched position. Further, if the concave portion is set longer in length in the circumferential direction of the rotating plate so that the neutral position sensor is positioned within the concave portion even by the overrun of the motor, the neutral position range becomes too wide. This may cause the output member to start pulling the rod for unlocking the door, for example, when the rotating plate is returned to the neutral position upon completion of the lock operation, or the delay of the lock operation or the unlock operation to start. Especially when the user operates the inside switch for opening the door and therefore the rotating plate is rotated in the counterclockwise direction, first the neutral position sensor is required to reach one end portion from the other end portion of the long concave portion. Then, when the neutral position sensor becomes positioned out of the concave portion by the rotation of the rotating plate, the output member finally starts the unlock operation. Accordingly, a relatively long time-lag may occur until the door is actually opened, thereby causing the user to feel uncomfortable. In order to obtain the certainty of each operation, the length of the concave portion, within which the neutral position sensor remains to be positioned even by the overrun of the motor, cannot be surely defined by matching the length of the concave portion to the overrun of the motor that is objectively predicted. The predicted length is further required to be multiplied by a safety factor.

Thus, a need exists for a door lock apparatus for a vehicle which can surely perform the lock operation and the unlock operation. Further, a need exists for the vehicle door lock apparatus for the vehicle that can decrease a time-lag from the command signal output to a start of the lock operation or the unlock operation with a simple structure to thereby provide a more comfortable feeling to the user.

SUMMARY OF THE INVENTION

According to an aspect of the present invention, a door lock apparatus for a vehicle includes a latch provided at one of a vehicle door and a vehicle-body and being rotatable between an open position in which the latch is disengageable from a striker provided at the other one of the vehicle door and the vehicle-body and a lock position in which the latch is prohibited to disengage from the striker, and an operating member for performing one of a lock operation for rotating the latch to the lock position and an unlock operation for rotating the latch to the open position by being moved from a neutral position to a first position by a driving source, and performing the other one of the lock operation and the unlock operation by being moved from the neutral position to a second position opposite to the first position relative to the neutral position by the driving source. The vehicle door lock apparatus also includes a control unit for switching a moving direction of the operating member driven by the driving source so that the operating member alternately performs the lock operation and the unlock operation, an operated member for being operated along with the operating member moved to the second position, a restricting member for restricting a movement of the operated member in a predetermined position when the operating member is moved to the first position, a detecting means for detecting the operated member being positioned adjacent to the predetermined position, and a housing for accommodating the latch, the operating member, the control unit, the operated member, the restricting member, and the detecting means. The control unit enters a standby mode through a process of bringing the operating member to return to the second position side after one of the lock operation and the unlock operation is completed so taht the operated member is not detected by the detecting means, and enters the standby mode through a process of bringing the operating member to return to the first position side after the other one of the lock operation and the unlock operation is completed so that the operated member is detected by the detecting means.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
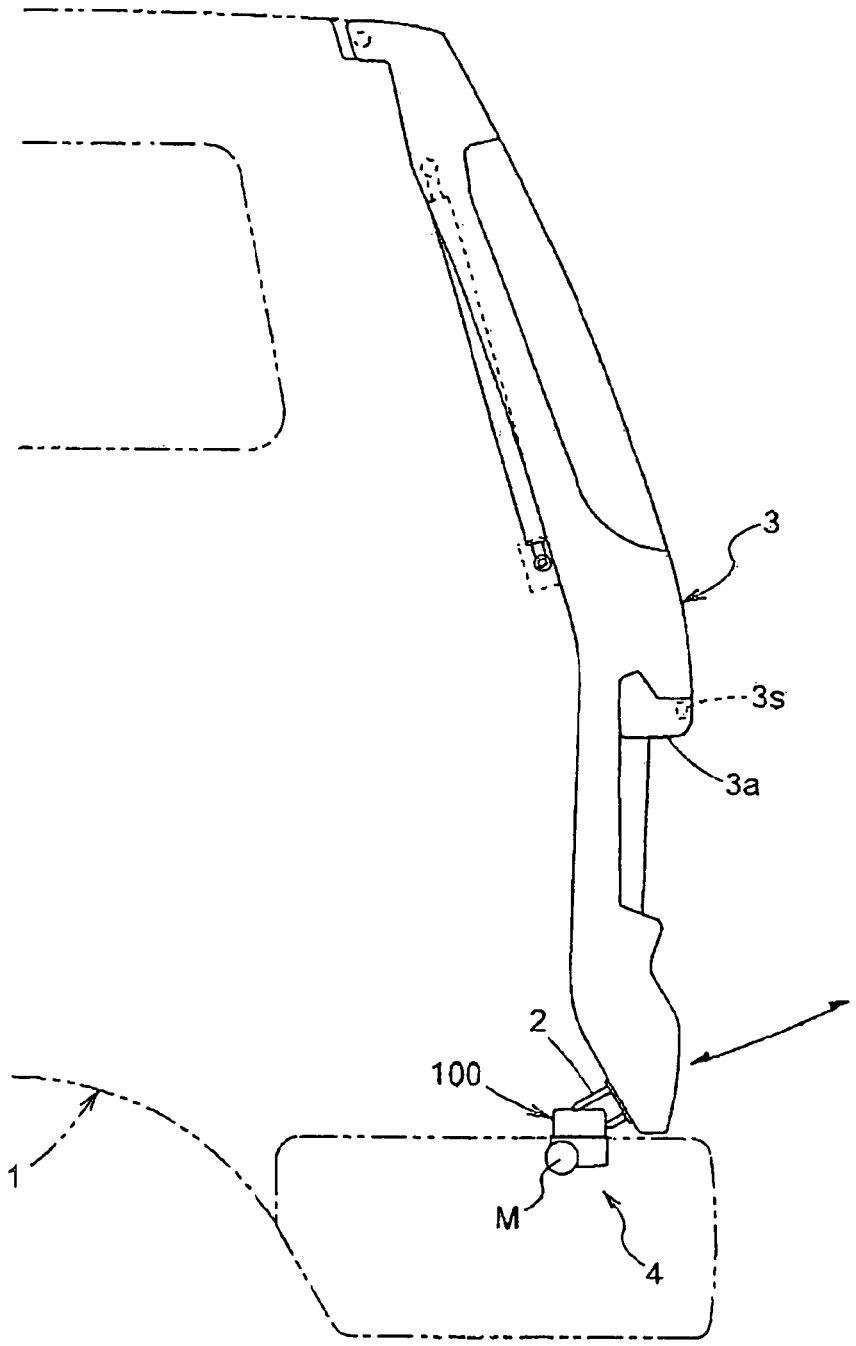
FIG. 1 is a side view of a rear portion of a vehicle equipped with a vehicle door lock apparatus according to an embodiment of the present invention.
Figure 2:
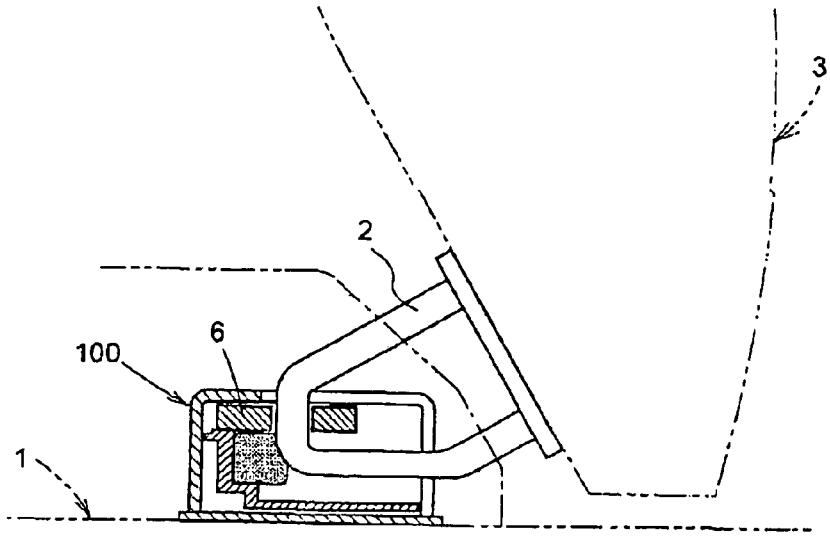
FIG. 2 is a cross-sectional view of the vehicle door lock apparatus in a full-latched state.
Figure 3:
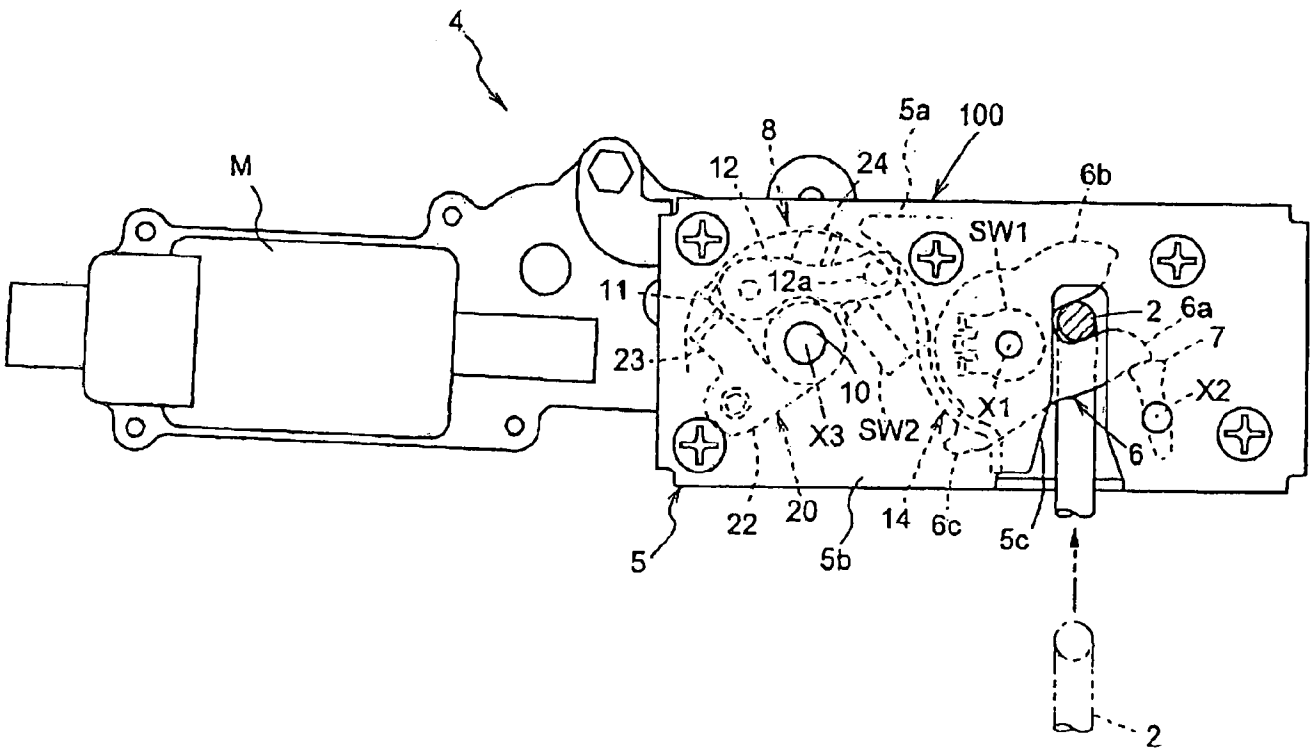
FIG. 3 is a plain view of the vehicle door lock apparatus of FIG. 1.
Figure 4:
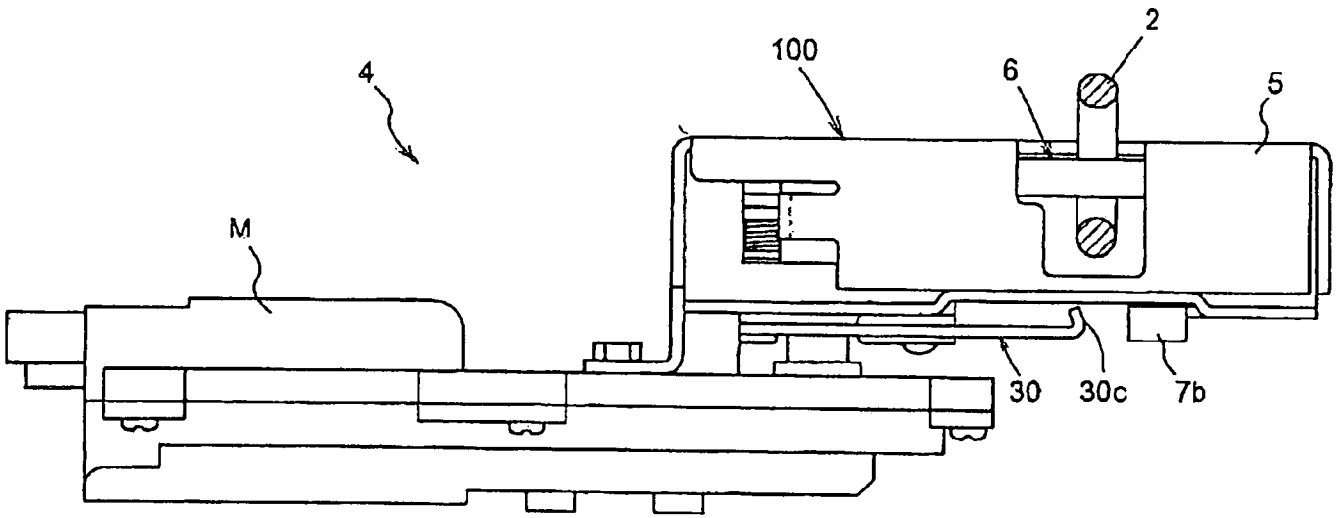
FIG. 4 is a front view of the vehicle door lock apparatus of FIG. 1.
Figure 6:
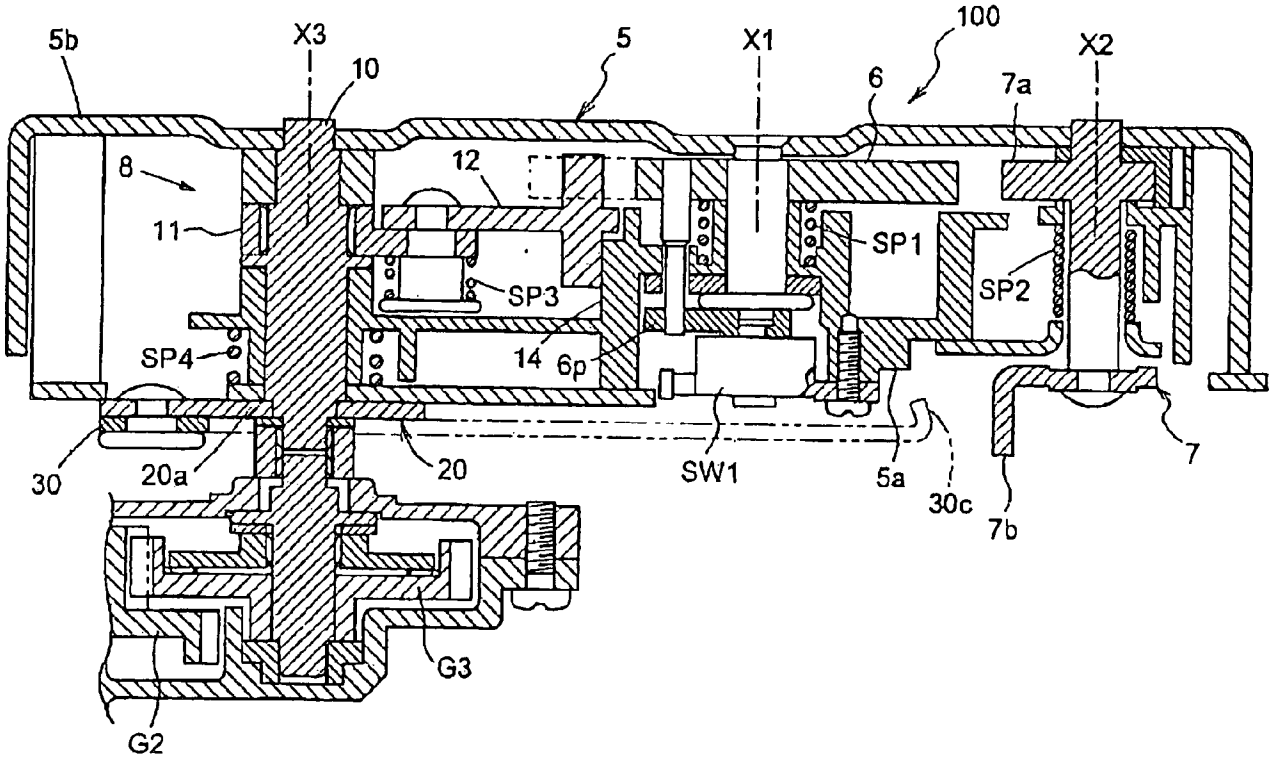
FIG. 6 is a cross-sectional view showing a portion of the vehicle door lock apparatus of FIG. 4.

An embodiment of the present invention is explained referring to attached drawings. FIGS. 1 and 2 show a door opening/closing mechanism 100 disposed between a body 1 and a door 3 (back door in the present embodiment) of a vehicle. The door opening/closing mechanism 100 includes a striker 2 provided at the door 3 and a door lock mechanism 4 provided in the vicinity of a rear edge portion of a floor of the body 1 as shown in FIG. 1. An open handle 3*a* is provided at an outboard side of the door 3. As shown in FIG. 3, the door lock mechanism 4 includes a synthetic-resin housing 5, a plate-shaped latch 6 that can pull the striker 2 into the body 1 side, a pawl 7 for restricting a rotation of the latch 6, and a lock operation mechanism 8 for locking or unlocking the door 3 via a motor-powered operation of the latch 6 and the pawl 7. The housing 5 includes a housing body 5*a* and a base 5*b* for covering the housing body 5*a* from an upper side of the vehicle as shown in FIG. 6 in detail. A concave portion 5*c* is formed on the base 5*b* for receiving the striker 2.

As shown in FIGS. 3 to 6, the latch 6 is rotatably supported on a shaft X1 provided perpendicularly on the base 5*b* of the housing 5. The latch 6 is biased in an arrow A1 direction by a coil spring SP1 and the like having a relatively strong biasing force toward a home position HP1 (state in FIG. 7, i.e. an example of open position). The latch 6 includes a first projection 6*a* provided close to an outer side of the body 1, i.e. on a side close the door 3, and a second projection 6*b* provided close to an inner side of the body 1, i.e. on a side away from the door 3. An engaging groove 6*g* for receiving the striker 2 is formed between the projections 6*a* and 6*b*. In addition, a half-engaging face 6*h* is formed on an inner side of the second projection 6*b*, i.e. a side close to the engaging groove 6*g*, of the latch 6 and pressed against an operating piece 7*a* of the pawl 7 in a half-latched position. In addition, a full-engaging face 6*f* is provided on an outer side of the first projection 6*a*, i.e. a side close to the door 3, and pressed against the operating piece 7*a* of the pawl 7 in a full-latched position. The latch 6 further includes a third projection 6*c* (operated portion) for receiving the lock operation by a closure arm 12 of the lock operation mechanism 8 (to be explained later). The third projection 6*c* is formed with an engaged concave portion 6*k* with which an operating pin 12*a* (to be explained later) is engageable. In the home position HP1, the third projection 6*c* is pressed against a cushion-shaped stopper 51*a* provided on the housing body 5*a* by a biasing force of the coil spring SP1.

A detected piece 6*p* (see FIG. 6) is provided at the latch 6, being integrally rotatable therewith for detecting a rotation status of the latch 6 as a rotation status detecting mechanism. A rotary switch SW1 (see FIG. 5) (control unit) is provided on the housing 5 for electrically detecting the detected piece 6*p*. The rotary switch SW1 includes a first contact Q1 (half-latch switch) for detecting the latch 6 in the half-latched state, a second contact Q2 (full-latch switch) for detecting the latch 6 in the full-latched state, and a third contact Q3 for grounding. The pawl 7 is rotatably supported on a shaft X2, which is substantially perpendicularly provided on the base 5*b*, between a first position ST (see FIG. 5) and a second position RT (see FIG. 13). In the first position ST, the operating piece 7*a* of the pawl 7 is positioned within a rotation locus of the first projection 6*a* or the second projection 6*b*. In the second position RT, the operating piece 7*a* is not positioned within the rotation locus of the first projection 6*a* or the second projection 6*b*. The pawl 7 is biased to return to the first position ST by a biasing force of a coil spring SP2. In the first position ST, the operating piece 7*a* is in contact with the half-engaging face 6*h* or the full-engaging face 6*f* to thereby prevente the latch 6 from returning to the home position HP1. In the second position RT, the latch 6 is permitted to return to the home position HP1. Further, in the first position ST, an end portion of the pawl 7 provided on an opposite side to the operating piece 7*a* with respect to the shaft X2 is pressed against a stopper 51*b* provided on the housing 5 by the biasing force of the coil spring SP2. An operated piece 7*b* is also arranged on radially outer side relative to the operating piece 7*a* with respect to the shaft X2.

The lock operation mechanism 8 includes a closing mechanism 8*a* for the lock operation of the door 3 and an opening mechanism 8*b* for the unlock operation of the door 3. The lock operation mechanism 8 also includes an origin switch SW2 (detecting means) provided on the housing body 5*a* for controlling a switching between the lock operation and the unlock operation. The closing mechanism 8*a* includes a first swing lever 11 (operating member) rotatably supported on a shaft X3 provided on the base 5*b* and the closure arm 12 (closure member) rotatably connected to a vicinity of a tip portion of the first swing lever 11 via a pin. The operating pin 12*a* extending substantially parallel to the shaft X3 is integrally formed on a vicinity of a tip portion of the closure arm 12. In addition, a smooth guide face 14 is provided on the housing body 5*a* for specifying a locus of the operating pin 12*a* in a predetermined shape. A coil spring SP3 is provided between the closure arm 12 and the first swing lever 11 for pushing the operating pin 12*a* toward the guide face 14 by biasing the closure arm 12 in a counterclockwise direction in FIG. 5. The first swing lever 11 is supported on a driving shaft 10, which is rotated in an arrow C1 or C2 direction by a rotation force transmitted from an electric motor M, such that the first swing lever 11 cannot rotate relative to the driving shaft 10. The rotation force of the electric motor M is transmitted to the driving shaft 10 via a worm gear fixed to a rotation shaft of the electric motor M, a third gear into which the driving shaft 10 is disposed, and a deceleration mechanism including a first gear and a second gear engaging with each other and arranged between the worm gear and the third gear. The third gear G3 and a portion of the second gear G2 are only shown in FIG. 6. A biasing force of the coil spring SP3 disposed between the closure arm 12 and the first swing lever 11 is set to a sufficient level so that the operating pin 12*a* is constantly pressed against the guide face 14 regardless of a position of the lock operation mechanism 8 in the vehicle or a moving distance of the operating pin 12*a* on the guide face 14. At the same time, if an object that prevents a sliding of the operating pin 12*a* on the guide face 14, such as an edge portion of the third projection 6*c* of the latch 6, instead of the engaged concave portion 6*k*, is positioned in the vicinity of the guide face 14 due to a malfunction of a CPU (control unit) caused by a noise and the like, the operating pin 12*a* is able to slide on the guide face 14 by detouring around the object, i.e. moving beyond the object, so that the closure arm 12, the guide face 14 and the like are not damaged.

Figure 5:
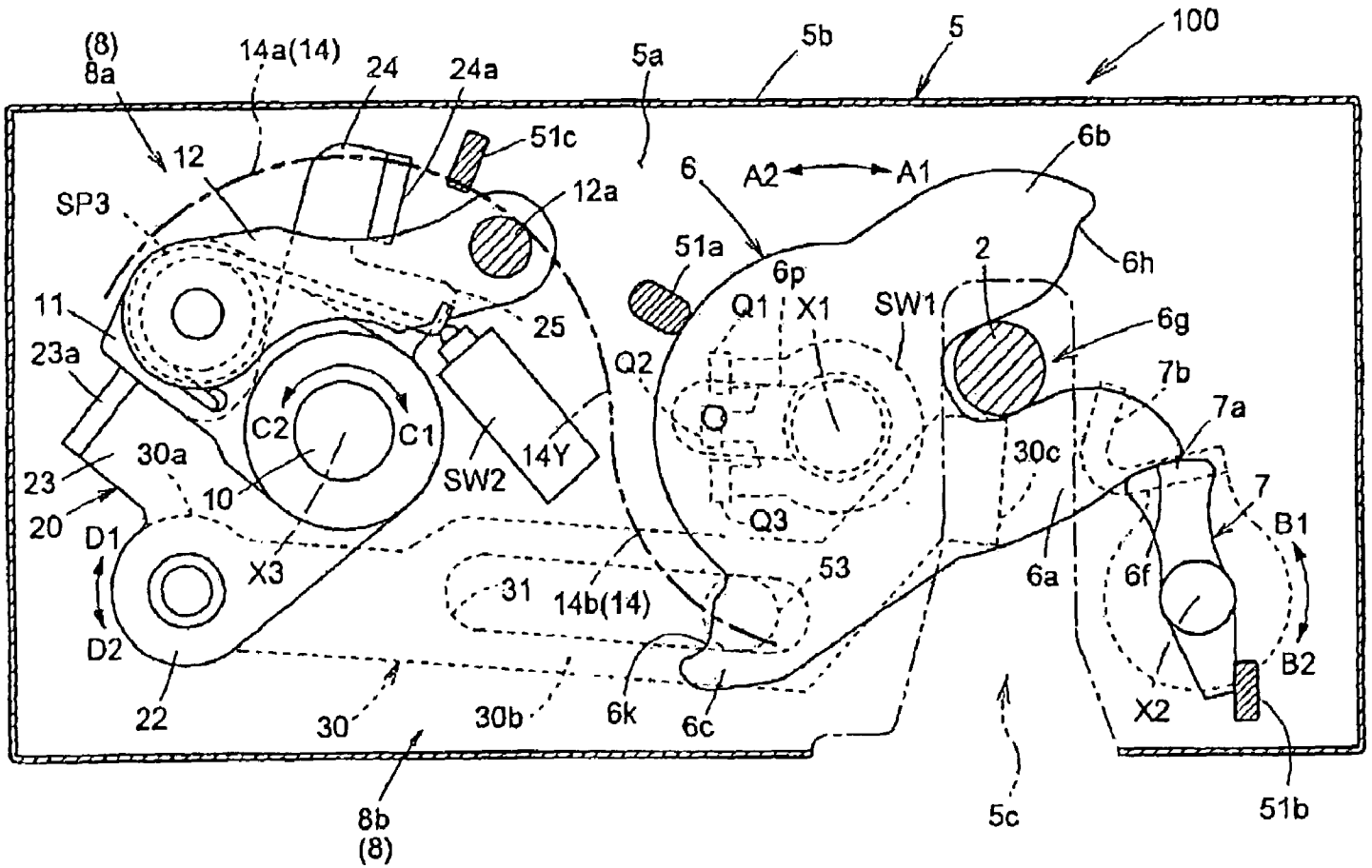
FIG. 5 is a front view showing a portion of the vehicle door lock apparatus of FIG. 3.
Figure 11:
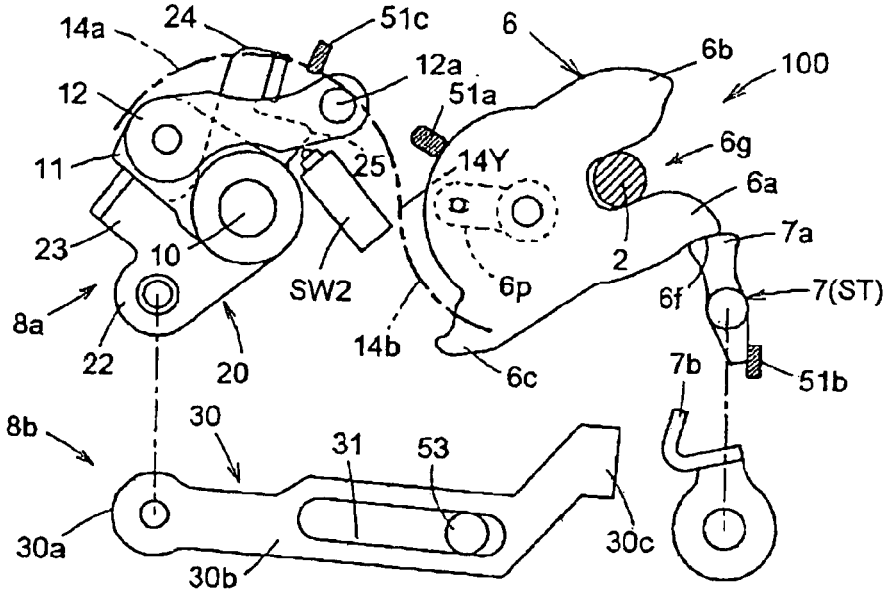
FIG. 11 is a view for explaining a process of the door lock operation (and the door unlock operation)

When the driving shaft 10 is kept rotating in the arrow C1 direction along with a normal rotation of the electric motor M, the first swing lever 11 is rotated as a unit with the driving shaft 10. Then, the operating pin 12*a* of the closure arm 12 is slid to move on the guide face 14 and engages with the engaged concave portion 6*k* (operated portion) formed on the third projection 6*c* of the latch 6, thereby rotating the latch 6 in an arrow A2 direction. The latch 6 becomes in a full-latched state as shown in FIGS. 5 and 11. The guide face 14 is formed by a first guide region 14*a* constituted by a portion of a first are provided with respect to the shaft X3 and a second guide region 14*b* constituted by a portion of a second are provided with respect to the shaft X1 being smoothly connected with each other via an inflection portion 14Y having a short (equal to or smaller than 5 mm, for example) or no length. A radius of the second are forming the second guide region 14*b* is set to a value whereby the operating pin 12*a* is constantly positioned on the rotation locus of the engaged concave portion 6*k* of the latch 6 moving with respect to the shaft X1 as long as the operating pin 12*a* is positioned an the second guide region 14*b*. When the operating pin 12*a* is positioned on the inflection portion 14Y, the operating pin 12*a* faces extremely close to the engaged concave portion 6*k* or is slightly in contact therewith. A radius of the first are forming the first guide region 14*a* is slightly larger than that of the second are and does not overlap with the rotation locus of the engaged concave portion 6*k* of the latch 6 as long as the operating pin 12*a* is positioned on the first guide region 14*a* (for example, a state in FIG. 5) in which the inflection portion 14Y is excluded.

Figure 7:
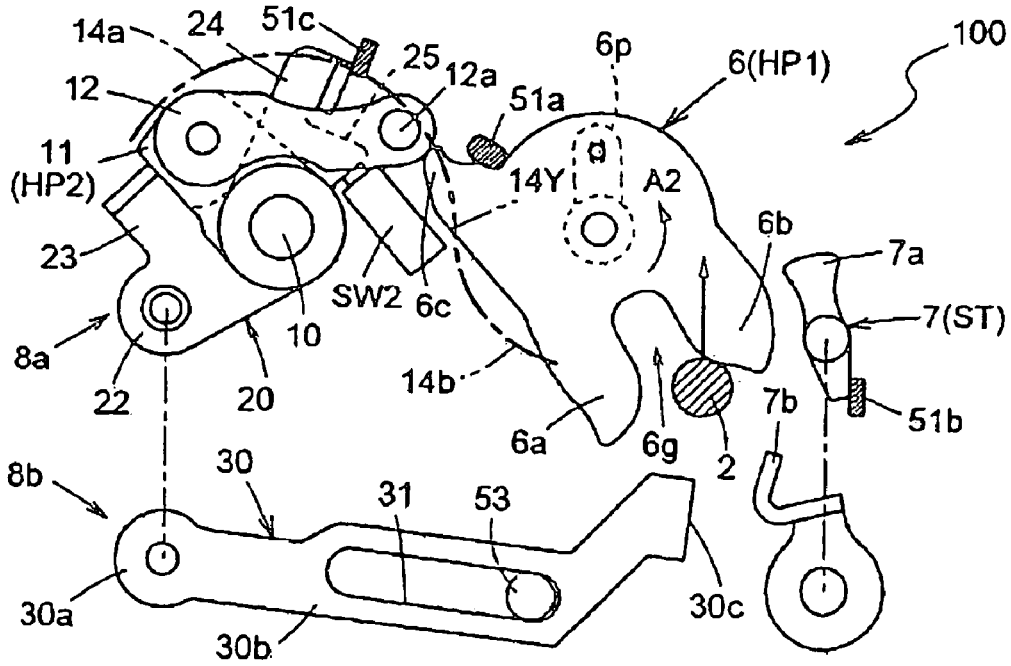
FIG. 7 is a view for explaining a process of a door lock operation (and a door unlock operation)

The opening mechanism 8*b* includes an unlock plate 20 (operated member) slidably supported on the shaft X3. The unlock plate 20 is supported on the driving shaft 10 so as to rotate relative thereto, which is a different condition from the first swing lever 11. The unlock plate 20 is biased in an arrow D1 direction in FIG. 5 by a coil spring SP4 (biasing member) disposed between the unlock plate 20 and the housing body 5*a*. As shown in FIGS. 5 and 6, the unlock plate 20 includes a supported portion 20*a* supported by the driving shaft 10 and from which a second swing lever portion 22 and a first control lever portion 24 extend as a unit with the supported portion 20*a* in different directions from each other. A release arm 30 (release member) is rotatably connected to a vicinity of a tip portion of the second swing lever portion 22 via a pin for releasing the pawl 7, i.e. disengaging the pawl 7 from the latch 6. As shown in FIG. 7, the release arm 30 includes a base end portion 30*a* rotatably supported on the second swing lever portion 22, a middle portion 30*b* extending in a transverse direction in FIG. 7 from the base end portion 30*a*, and an operating portion 30*c* extending obliquely upward from the middle portion 30*b*. A guide hole 31 is formed on the middle portion 30*b* and in which a control pin 53 perpendicularly formed on the housing body 5*a* is positioned. Thus, a link mechanism is constituted by the base end portion 30*a* of the release arm 30 rotatably supported on the second swing lever portion 22 and the guide hole 31 whose moving area is restricted only in a substantially transverse direction in FIG. 7 by the control pin 53. When the unlock plate 20 is rotated in an arrow D2 direction (i.e., counterclockwise direction) in FIG. 5, the operating portion 30*c* of the release arm 30 is moved to the pawl 7 side according to the link mechanism.

In addition, as shown in FIG. 5, a second control lever portion 23 extends laterally and integrally from a vicinity of a base end portion of the second swing level portion 22. An operated piece 23*a* engageable with the first swing lever 11 of the closing mechanism 8*a* is perpendicularly formed on an edge portion of the second control lever portion 23. When the driving shaft 10 is rotated in the arrow C2 direction due to a reverse rotation of the electric motor M, the first swing lever 11 rotated in the same direction, i.e. the arrow C2 direction, pushes and operates together with the operated piece 23*a*. Then, the unlock plate 20 is rotated in the arrow D2 direction by overcoming the biasing force of the coil spring SP4. Finally, the release arm 30 releases the pawl 7, i.e. disengages the pawl 7 from the latch 6.

A restricted piece 24*a* is formed perpendicularly in the vicinity of a tip portion of the first control lever portion 24. Then, a cushion-shaped stopper 51*c* (restricting member) is provided on the housing body 5*a*, being partially positioned within the rotation locus of the restricted piece 24*a*. That is, the rotation of the unlock plate 20 by the coil spring SP4 in the D1 direction is restricted by the restricted piece 24*a* being in contact with the stopper 51*c*.

A switch operating portion 25 for pressing the origin switch SW2 extends laterally from a vicinity of the base end portion of the first control lever portion 24 as shown in FIG. 5. A position relationship between the origin switch SW2 and the switch operating portion 25 is that the switch operating portion 25 presses the origin switch SW2 to turn in ON status immediately before the restricted piece 24*a* of the first control lever portion 24 becomes in contact with the stopper 51*c* while the unlock plate 20 is rotated in the D1 direction.

Figure 14:
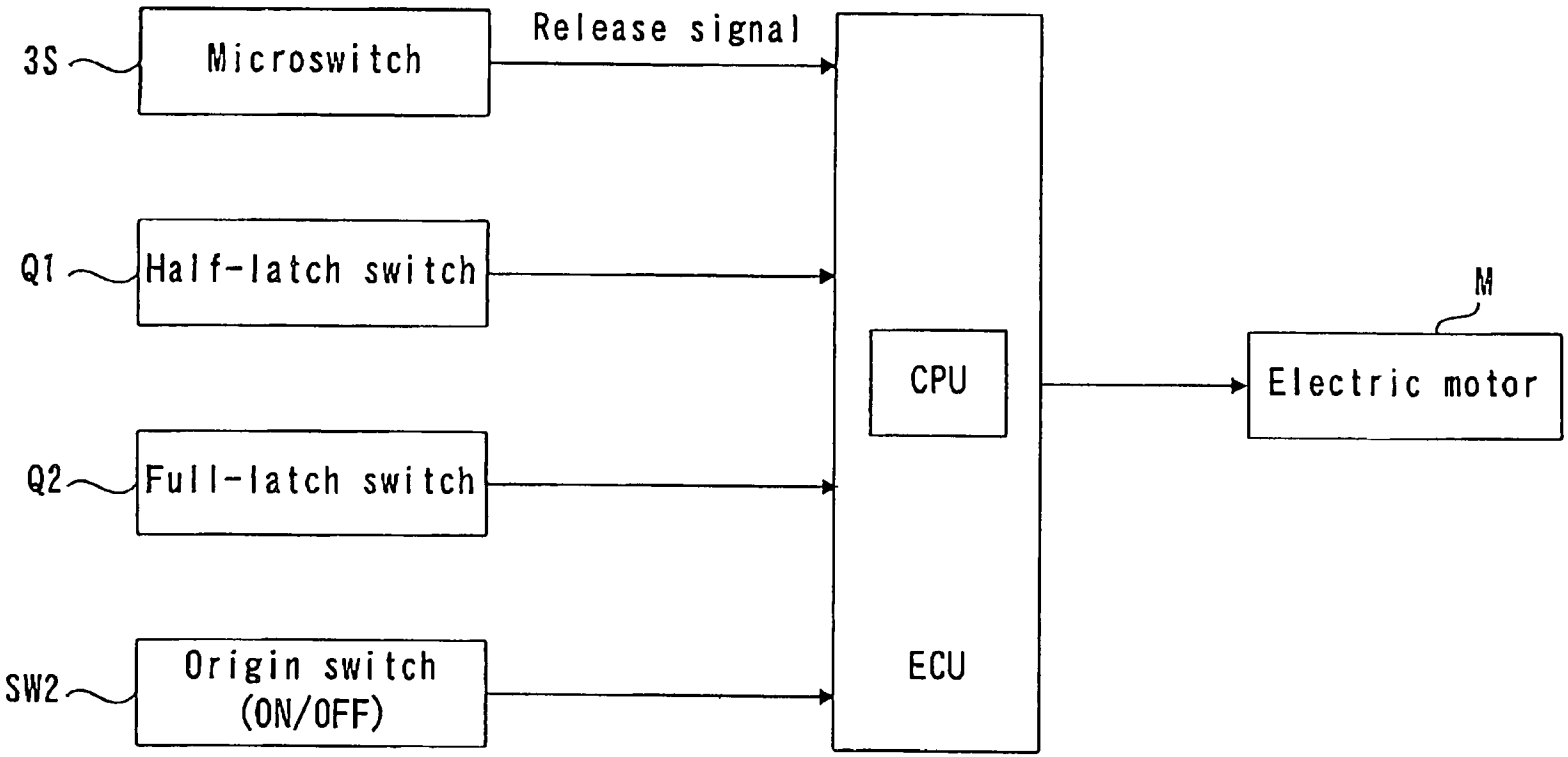
FIG. 14 is a block view showing a control unit.

The vehicle is equipped with an ECU (electronic control unit). As shown in FIG. 14, the CPU provided in the ECU sends a command signal of normal rotation, reverse rotation or stop to the electric motor M based on a status of the origin switch SW2 (ON or OFF) after receiving a signal from a microswitch 3*s* (that sends a release signal) provided at the open handle 3*a* of the door 3, the half-latch switch Q1, the full-latch switch Q2 (each indicates switching state of the rotation of the latch 6), and the origin switch SW2 (that indicates a present status of the door lock mechanism 4).

Figure 15:
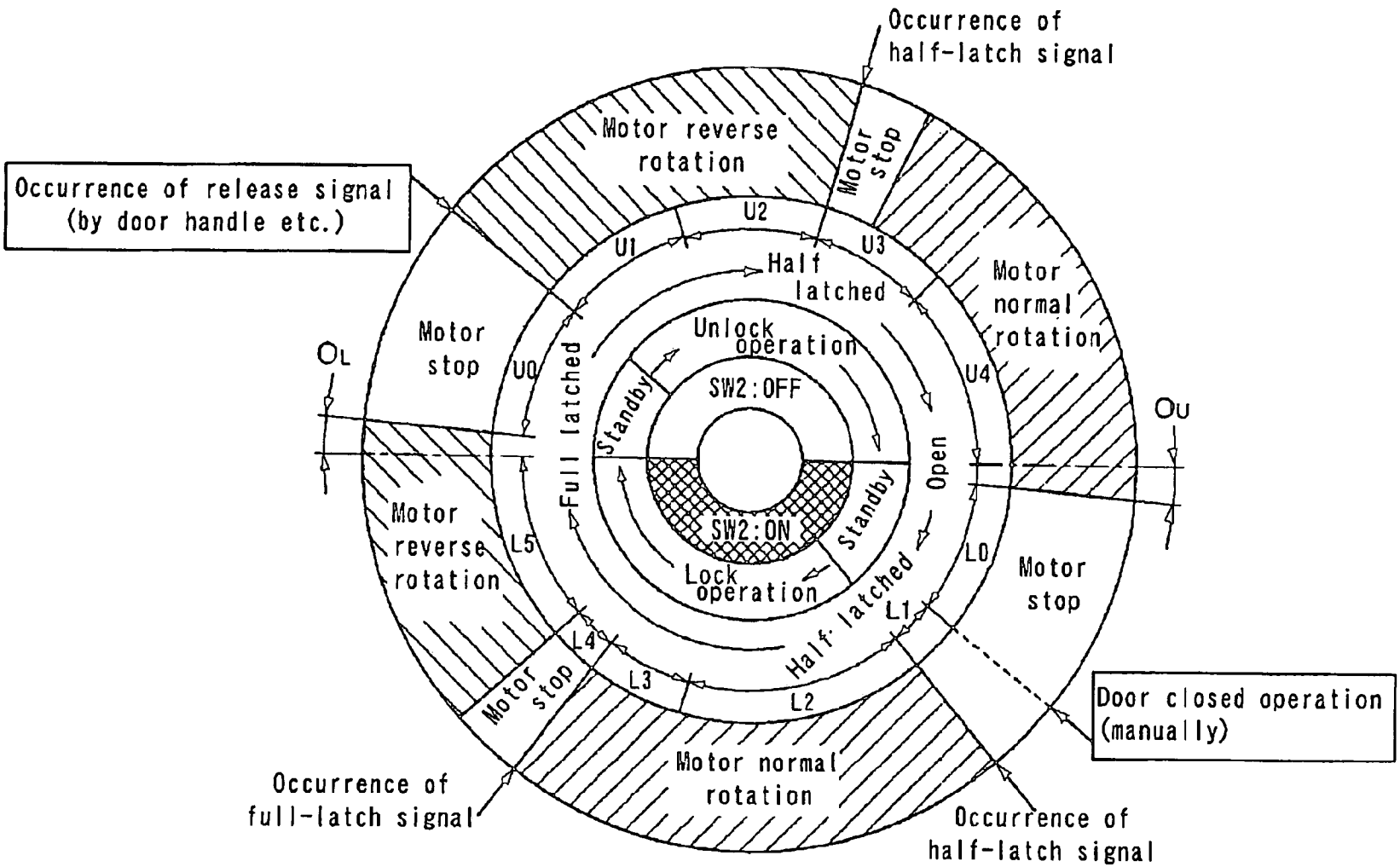
FIG. 15 is a view for explaining each process of the door lock operation and the door unlock operation.

Next, the lock operation and the unlock operation by the door opening/closing mechanism 100 are explained as follows based on main processes. FIG. 15 is a diagram showing each status of the latch 6 (open, half-latch, or full-latch), the electric motor M (normal rotation, reverse rotation or stop), and the origin switch SW2 (ON or OFF) in each operation of the door 3 based on the passage of time. Each process (L0 to L5, and U0 to U4) is indicated radially inner side of a ring showing a status of the electric motor M. A length in a circumferential direction of each process, however, does not correspond to time required for an actual situation.

The lock operation of the door 3 by the closing mechanism 8*a* of the door opening/closing mechanism 100 is performed based on each process mentioned below.

L0(as shown in FIG. 15): Door Open State

When the door 3 is open, the latch 6 is in the home position HP1 in which the third projection 6*c* of the latch 6 is pressed against the stopper 51*a*. The pawl 7 is in the first position ST in which the end portion of the pawl 7 provided opposite side to the operating piece 7*a* with respect to the shaft X2 is pressed against the stopper 51*b*. The first swing lever 11 of the closing mechanism 8*a* is stopped in a position whereby the switch operating portion 25 of the unlock plate 20 keeps the origin switch SW2 in ON status (i.e. home position HP2). At this time, the restricted piece 24*a* of the first control lever portion 24 can be pressed against the stopper 51*c*. In addition, at this time, the operating pin 12*a* of the closure arm 12 is positioned out of the rotation locus of the third projection 6*c* of the latch 6. This state is a preliminary step before the substantial door lock operation is initiated. The substantial door lock operation is initiated from a next process.

L1(as Shown in FIG. 15): Obtaining the Half-latched State

Figure 8:
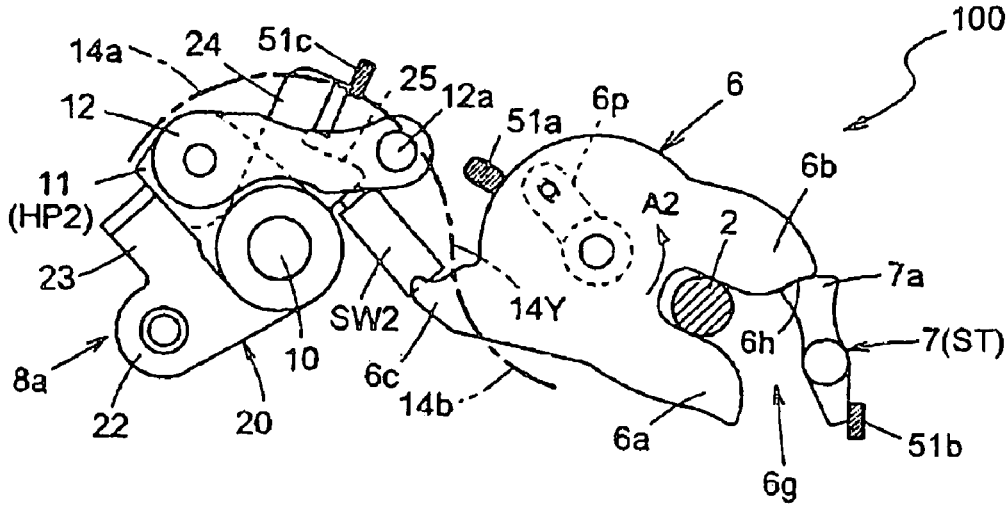
FIG. 8 is a view for explaining a process of the door lock operation.

When the user slightly manually closes the door 3 from the door open state mentioned above, the second projection 6*b* of the latch 6 is pushed by the striker 2 of the door 3 to thereby rotate the larch 6 in the A2 direction by overcoming the biasing force of the coil spring SP1. The second projection 6*b* is kept rotating to push the pawl 7 toward the second position RT. Finally, when the second projection 6*b* is once positioned above the operating piece 7*a* of the pawl 7, the latch 6 becomes in the half-latched state by the pawl 7 returning to the first position ST and the operating piece 7*a* of the pawl 7 engaging with the half-engaging face 6*h* as shown in FIG. 8. At this time, the detected piece 6*p* of the latch 6 is detected by the first contact Q1 of the rotary switch SW1. An electrical signal indicating the half-latched state (in the door lock operation) (indicated as "occurrence of the half-latch signal" in FIG. 15) is sent from the rotary switch SW1 and received by the CPU, which then sends the control signal to the electric motor M to rotate the motor in the normal rotation direction.

L2(as Shown in FIG. 15): Starting to Pull the Striker into the Latch

Figure 9:
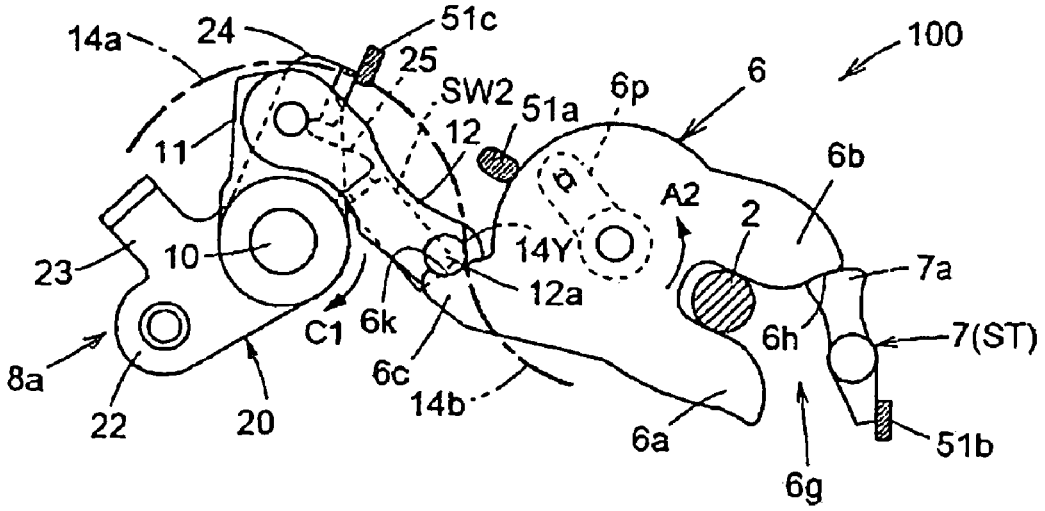
FIG. 9 is a view for explaining a process of the door lock operation.

When the first swing lever 11 is rotated in the C1 direction (clockwise direction) together with the driving shaft 10 from the home position HP2 due to the normal rotation of the electric motor M that has been started at the end of the L1 process, the operating pin 12*a* of the closure arm 12 is slid to move on the guide face 14. The operating pin 12*a* engages with the third projection 6*c* of the latch 6 in a position where the operating pin 12*a* just passes over the inflection region 14Y. Then, as shown in FIG. 9, the operating pin 12*a* is kept sliding on the second guide region 14*b*, thereby rotating the latch 6 in the A2 direction. As a result, the striker 2 engaged within the engaging groove 6*g* starts to be pulled into the concave portion 5*c* of the housing 5.

L3(as Shown in FIG. 15): Full-latch Preparing State

When the first swing lever 11 is kept rotating by the normal rotation of the electric motor M and the operating pin 12*a* is slid on a last half portion of the second guide region 14*b* to thereby rotate the latch 6 in the A2 direction, the first projection 6*a* of the latch 6 then rotates the pawl 7 towards the second position RT. Finally, when the first projection 6*a* is once positioned above the operating piece 7*a* of the pawl 7, the latch 6 becomes in the full-latch preparing state by the pawl 7 returning to the first position ST and the operating piece 7*a* of the pawl 7 facing the full-engaging face 6*f*. The first swing lever 11 is still kept rotating by the normal rotation of the electric motor M to the next process. The full-latch preparing step is included in the full-latch state in the broad sense.

L4(as Shown in FIG. 15): Over-stroke Process

Figure 10:
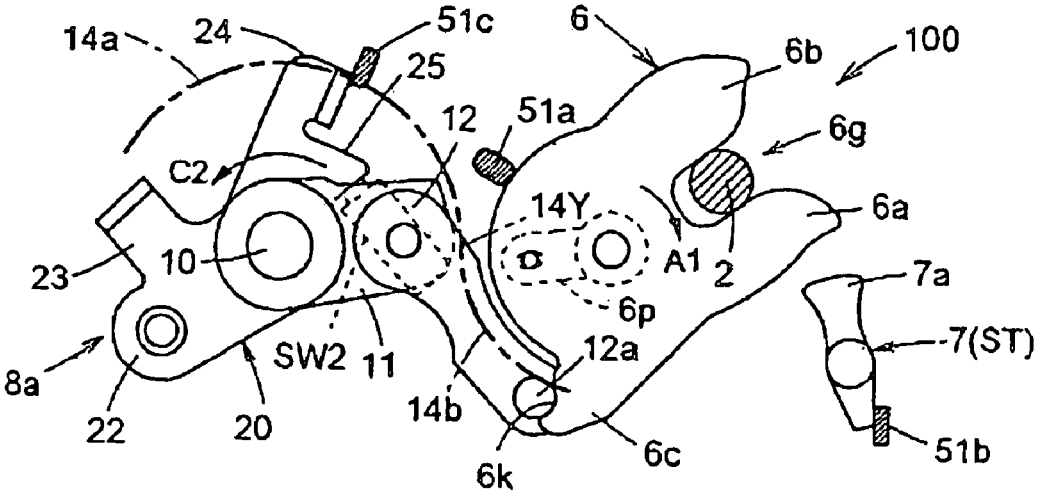
FIG. 10 is a view for explaining a process of the door lock operation.

When the first swing lever 11 is kept rotating by the normal rotation of the electric motor M and the operating pin 12*a* is slid on the last half portion of the second guide region 14*b* to thereby further rotate the latch 6 in the A2 direction, the over-stroke process in which the first projection 6*a* of the latch 6 becomes once separated from the operating piece 7*a* is obtained as shown in FIG. 10. At this time, the detected piece 6*p* is detected by the second contact Q2 of the rotary switch SW1. Then, an electrical signal indicating the full-latched state is sent from the rotary switch SW1 and received by the CPU, which then stops the motor M once. Then the motor M sends the control signal for rotating the electric motor M in the reverse rotation direction. The over-stroke process is included in the full-latched state in the broad sense.

L5(as Shown in FIG. 15): Return Process of the Closing Mechanism to the Original Position The first swing lever 11 is started to be rotated in the C2 direction due to the reverse rotation of the electric motor M. When the operating pin 12*a* returns to move slightly on the second guide region 14*b* toward the first guide region 14*a*, the latch 6 is rotated ill the A1 direction by the biasing force of the coil spring SP1, thereby obtaining the actual full-latched state (not shown) in which the first projection 6*a* is in contact with the operating piece 7*a* of the pawl 7 again and the operating pin 12*a* is separated from the third projection 6*c* of the latch 6. Next, the reverse rotation of the electric motor M is further continued and thus the operating pin 12*a* enters into the first guide region 14*a*. Finally, when the first swing lever 11 presses the second control lever portion 23 slightly in the D2 direction, the restricted piece 24*a* of the first control lever portion 24 becomes slightly separated from the stopper 51*c* as shown in FIG. 11. The switch operating portion 25 turns the origin switch SW2 in OFF status subsequently. The CPU stops the electric motor Ac based on the signal output from the origin switch SW2 (indicating completion of the lock operation) at a time of the origin switch SW2 turned in OFF status. Then, the CPU enters into a standby anode.

In the standby mode, the unlock plate 20 may be constituted to be further pushed in the D2 direction by the overrun of the first swing lever 11 and stopped in a position whereby the switch operating portion 25 becomes separated from an operated piece of the origin switch SW2 during a time-lag (corresponding to an overrun amount OL of the electric motor M shown in FIG. 15) from a time of the origin switch SW2 turned in OFF status to a time of the electric motor M actually stopped. In this case, however, if the switch operating portion 25 is widely separated from the origin switch SW2, the following unlock operation by the opening mechanism 8*b* is slightly delayed to start. Therefore, the overrun amount OL is desirably reduced so that the distance between the switch operating portion 25 and the origin switch SW2 is minimized. In the standby mode, it should be noted that the operating pin 12*a* of the closure arm 12 is positioned out of the rotation locus of the third projection 6*c* of the latch 6.

The unlock operation of the door 3 by the opening mechanism 8*b* of the door opening/closing mechanism 100 is performed according to each process in the following.

U0(as Shown in FIG. 15): Door Closed State

When the door 3 is closed, the door opening/closing mechanism 100 is in the same state as a final stage of the L5: return process of the closing mechanism to the original position as shown in FIG. 11. That is, the latch 6 is in the full-latched state as the full-engaging face 6*f* is pressed against the operating piece 7*a* of the pawl 7. In addition, the first swing lever 11 of the closing mechanism 8*a* presses the second control lever portion 23 in the D2 direction to thereby obtain a small clearance between the restricted piece 24*a* of the first control lever portion 24 and the stopper 51*c*. That is, the origin switch SW1 is not pressed by the switch operating portion 26 of the unlock plate 20 and is in OFF status. This state is a preliminary step before the door unlock operation is actually initiated. The substantial door unlock operation is initiated from a next process.

U1(as Shown in FIG. 15): Staring Operation of the Release Arm 30

Figure 12:
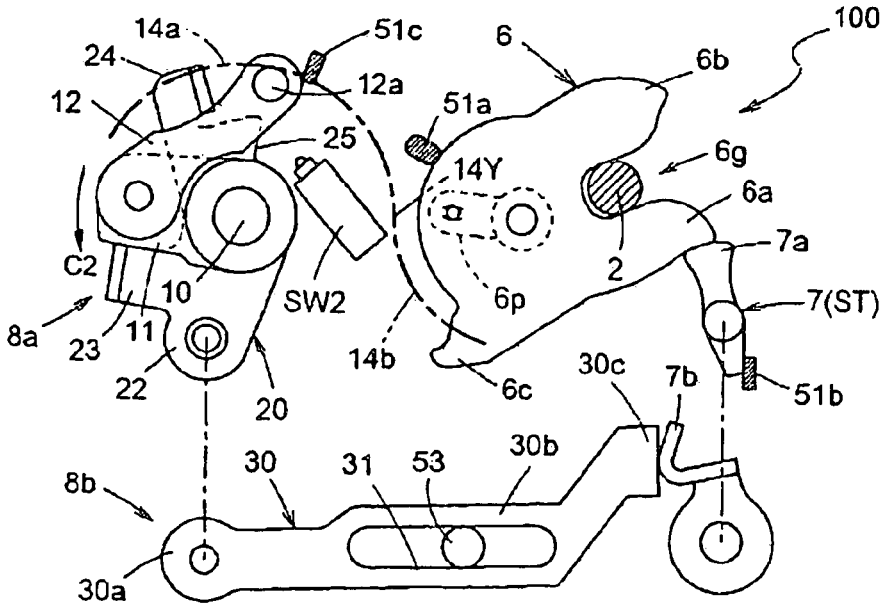
FIG. 12 is a view for explaining a process of the door unlock operation.

When the open handle 3*a* provided at the outside of the door 3, an open lever (not shown) provided at a driver seat or the like is operated from the above-mentioned state, the release signal (shown as "occurrence of release signal" in FIG. 15) is sent to the CPU from the microswitch 3*s* operated together with the open handle 3*a*. The CPU then sends a control signal for rotating the electric motor M in the reverse rotation direction. The first swing lever 11 is rotated in the C2 direction (counterclockwise direction) from the home position HP2 side as shown in FIG. 12. Then, the second control lever portion 23 of the unlock plate 20, which engages with the first swing lever 11 via the operated piece 23*a*, is moved in the D2 direction, thereby moving the release arm 30 rotatably connected to the second swing lever portion 22 toward the pawl 7 by the aforementioned link mechanism.

U2(as Shown in FIG. 15): Releasing of the Pawl 7

The operating portion 30*c* of the release arm 30 starts to be in contact with the operated piece 7*b* of the pawl 7 to thereby rotate the pawl 7 in a B2 direction as the reverse rotation of the electric motor M is continued. When the pawl 7 is moved to the second position RT, the operating piece 7*a* of the pawl 7 becomes out of the rotation locus of the first projecting 6*a* of the latch 6. Thus, the latch 6 is disengaged and released from the pawl 7 and started to return to the A1 direction toward the home position HP1. This returning process of the latch 6 is performed at the same time as the latch 6 brings the striker 2 to be outwardly withdrawn from the concave portion 5*c* of the base 5*b* by the biasing force of the coil spring SP1.

U3(as Shown in FIG. 15): Obtaining the Half-latched State

Figure 13:
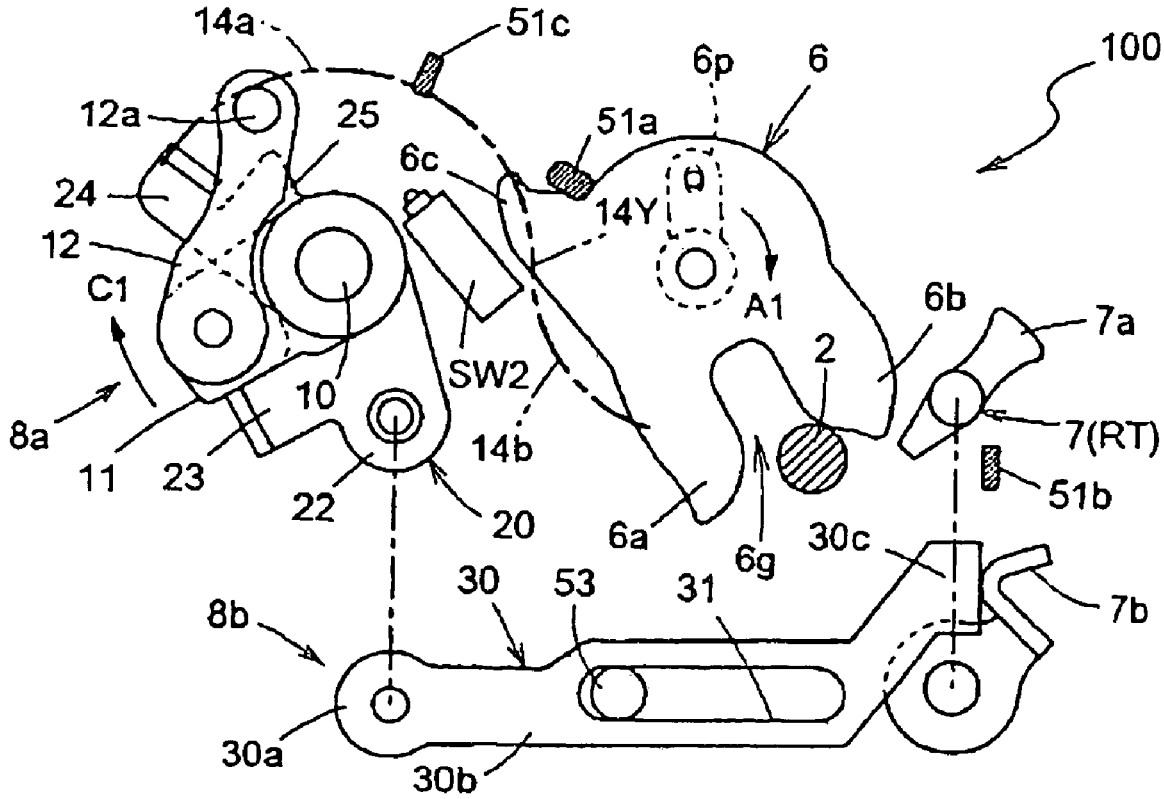
FIG. 13 is a view for explaining a process of the door unlock operation.

When the latch 6 reaches the half-latched position during the above-mentioned returning process, the detected piece 6*p* of the latch 6 is detected by the first contact Q1 of the rotary switch SW1. Then, an electrical signal indicating the half-latched state (in the door unlock operation) is sent from the rotary switch SW1 and received by the CPU, which then once stops the electric motor M and sends a control signal for rotating the motor M in the normal rotation direction. The first swing lever 11 is therefore rotated in the C1 direction (clockwise direction) as well as the unlock plate 20 pressed against the first swing lever 11 via the operated piece 23*a* is rotated in the D1 direction (clockwise direction). The release arm 30 starts to be separated from the pawl 7. FIG. 13 shows a moment when the latch 6 reaches the home position HP1 in which the latch 6 pushes the striker 2 toward an opening end portion, i.e. a portion close to the door 3, of the concave portion 5*c* of the base 5*b* with the motor M in a stopped state.

U4(as Shown in FIG. 15): Return Process of the Opening Mechanism to the Original Position When the motor M is kept rotating in the normal rotation direction, the unlock plate 20 rotated in the D1 direction together with the first swing lever 11 finally pushes the origin switch SW2 to turn in ON status via the switch operating portion 25 (same state as shown in FIG. 7). The CPU stops the motor M based on the signal output from the origin switch SW2 (indicating completion of the unlock operation) at a time of the origin switch SW2 turned in ON status. Then, the CPU enters into the standby mode. At this time, as shown in FIG. 7, the unlock plate 20 may be returned to a state in which the restricted piece 24*a* of the first control lever portion 24 is pressed against the stopper 51*c* during a time-lag (corresponding to an overrun amount OU of the motor M shown in FIG. 15) from a time of the origin switch SW2 being pressed and turned in ON status to a time of the motor M actually stopped. If the first swing lever 11 is kept overrunning after the restricted piece 24*a* is pressed against the stopper 51*c*, however, the first swing lever 11 becomes not in contact with the operated piece 23*a* of the unlock plate 20 any more, thereby delaying the following lock operation to start by the closing mechanism 8*a*. Thus, the overrun amount OU is desirably reduced to a level by which the first swing lever 11 is kept engaging with the operated piece 23*a*. This structure may be achieved by setting a relative position between the restricted piece 24*a* and the stopper 51*c*, and a moving stroke of the operated piece of the origin switch SW2 such that the restricted piece 24*a* of the unlock plate 20 is just pressed against the stopper 51*c* when the unlock plate 20 is finally stopped, including the overrun, after the switch operating portion 25 turns the origin switch SW2 in ON status.

Alternatively, the overrun amount OU may be modified so that the first saving lever 11 is stopped before the restricted piece 24*a* of the first control lever portion 24 is pressed against the stopper 51*c*. In this case, the restricted piece 24*a* of the first control lever portion 24 is pressed against the stopper 51*c* by the coil spring SP4 for the first time in the process of L2: starting to pull the striker into the latch when the first swing lever 11 is rotated in the C1 direction by the normal rotation of the motor M. In the aforementioned standby mode, it should be noted that the operating pin 12*a* of the closure arm 12 is positioned out of the rotation locus of the third projection 6*c* of the latch 6.

According to the above-mentioned present embodiment, the door lock operation and the door unlock operation bay the CPU are performed based on the following principle. When the CPU is in the standby mode with the latch 6 in the full-latched state and while the door unlock operation is performed from that standby mode, the origin switch SW2 is constantly in OFF status. The origin switch SW2 is turned in ON status with the completion of the door unlock operation. When the CPU is in the standby mode with the door unlocked and while the door lock operation is performed from that standby mode, the origin switch SW2 is constantly in ON status. The origin switch SW2 is turned in OFF status with the completion of the door lock operation. Then, the initial state in which the latch is in the full-latched state with the CPU in the standby mode is returned.

Further, according to FIGS. 5, 7, 11, and 15 in which each process performed in the door lock operation and the door unlock operation is shown along with the overrun amount OL and OU occurring at each final stage of the lock operation and the unlock operation, the origin switch SW2 is turned in OFF status after the completion of the door lock operation and then the standby mode for the door unlock operation is initiated bar the CPU. The origin switch SW2 is turned in ON status after the completion of the door unlock operation and then the standby mode for the door lock operation is initiated by the CPU. The aforementioned condition for the control of the CPU is not changed even if the overrun amount OL or OU of the motor M is large for any reason. Thus, the door lock operation and the door unlock operation are surely performed. According to the present embodiment, practically, the overrun amount OU occurring upon the completion of the door unlock operation (returning operation) is defined extremely small by the stopper 51*c* for forcedly stopping the overrun of the unlock plate 20 via the switch operating portion 25.

Furthermore, the CPU can perform the control based on the ON/OFF status of the single detecting means at a time of the occurrence of the half-latch signal or the release signal during the door closing operation. Then, the following two advantages may be obtained. First, a structure of the detecting means is simple and thus high reliability and durability of the operation thereof may be assured. The ON/OFF switch SW2 of a cheap pressing type can be employed. In addition, only one switch is required (though the switch SW1 for detecting the status of the latch is required). Next, the control algorithm for the door lock or the door unlock operation is extremely simple, thereby preventing the malfunction thereof.

The embodiment of the present invention is not limited to the above but modified as follows. The release arm 30 may be rotatably supported on the first swing lever 11 instead of the unlock plate 20. In this case, the second swing lever portion 22 and the second control lever portion 23 may be detached from the unlock plate 20 of the present embodiment to be united with the first swing lever 11. Then, the release aim 30 may be rotatably supported on the second swing lever portion 22 that is united with the first swing lever 11. The unlock plate 20 may be formed with the first control lever portion 24 including the restricted piece 24*a* to be restricted by the stopper 51*c*, and the switch operating portion 25 for pressing the origin switch SW2. In this case, the moving plane of the first swing lever 11 and that of the release arm 30 may be required to be positioned different from each other for the door lock operation. Further, the guide hole 31 of the release arm 30 may be formed slightly longer in order to avoid bumping into the control pin 53. Alternatively, contrary to the above embodiment, the closure member (closure arm 12) for the lock operation may be rotatably supported on the operated member (unlock plate 20) while the release member (release arm 30) may be rotatably supported on the operating member (first swing lever 11).

The movement of the operating member (first swing lever 11) by a driving source is not limited to the rotation with respect to one shaft. The operating member for performing the lock operation and the unlock operation may be constituted to move along a linear rail. For example, an operated member to be operated along the rail may be employed for the unlock operation, and a restricting member for restricting the movement of the operated member in a predetermined position and a detecting means for detecting the operated member positioned adjacent to the predetermined position may be employed for the lock operation for constituting the door lock mechanism according to the present invention.

The origin switch SW2 is not limited to the above-mentioned ON/OFF switch of the pressing type. It is only required to detect approach of the switch operating portion 25 as the operated member and thus a magnet proximity switch, a contact for directly electrically detecting the switch operating portion 25, or a light sensor may be employed.

Further, an emergency operation lever for permitting the latch 6 to return to the home position HP1 by forcedly rotating the pawl 7 in the arrow B2 direction may be provided at a vehicle inner side as a means for directly performing the unlock operation of the door 3 not via the door opening/closing mechanism 100.

According to the aforementioned embodiment, the striker 2 is provided at the door 3 and the door lock mechanism 4 is provided at the body 1. However, contrary to the above, the striker 2 may be provided at the body 1 and the door lock mechanism 4 may be provided at the door 3. In this case, a microswitch for sending the release signal to the CPU when the open handle is slightly operated can be provided at the open handle arranged at the outside of the door 3. Further, if the door unlock operation is not performed by the door opening/closing mechanism 100 due to a defect of the power supply from the battery in case that the user even operates the microswitch, the unlock operation of the door 3 can be performed by the pawl 7 connected to the open handle via a cable to be forcedly rotated in the B2 direction, which is caused by the open handle further widely operated. The door opening/closing mechanism 100 according to the present invention may be adopted not only to the back door as mentioned above but also a side door and the like.

Therefore, the door lock apparatus of the present invention may surely and constantly perform the lock operation and the unlock operation with a simple structure regardless of the amount of the overrun of the operating member.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A door lock apparatus for a vehicle comprising:

a latch provided at one of a vehicle door and a vehicle-body and being rotatable between an open position in which the latch is disengageable from a striker provided at the other one of the vehicle door and the vehicle-body and a lock position in which the latch is prohibited to disengage from the striker;

an operating member for performing one of a lock operation for rotating the latch to the lock position and an unlock operation for rotating the latch to the open position by being moved from a neutral position to a first position by a driving source, and performing the other one of the lock operation and the unlock operation by being moved from the neutral position to a second position opposite to the first position relative to the neutral position by the driving source;

a control unit for switching a moving direction of the operating member driven by the driving source so that the operating member alternately performs the lock operation and the unlock operation;

an operated member for being operated along with the operating member moved to the second position;

a restricting member for mechanically restricting a movement of the operated member in a predetermined position when the operating member is moved to the first position;

a detecting means for detecting the operated member being positioned adjacent to the predetermined position; and wherein the control unit enters a standby mode through a process of bringing the operating member to return to the second position side after one of the lock operation and the unlock operation is completed so that the operated member is not detected by the detecting means, and enters the standby mode through a process of bringing the operating member to return to the first position side after the other one of the lock operation and the unlock operation is completed so that the operated member is detected by the detecting means.

2. A door lock apparatus for a vehicle according to claim 1, wherein the operating member performs the lock operation by being moved from the neutral position to the first position and performs the unlock operation by being moved from the neutral position to the second position, and the detecting means includes a switch that is turned in ON status by a pressing operation of the operated member approaching the neutral position from the second position and turned in OFF status by a cancellation of the pressing operation of the operated member moving away from the neutral position to the second position.

3. A door lock apparatus for a vehicle according to claim 2, further comprising:

a biasing member for constantly biasing the operated member from the second position side to the restricting member side.

4. A door lock apparatus for a vehicle according to claim 3, wherein the operating member is rotated by the driving source with respect to a shaft and performs the lock operation via a closure member connected to one of the operating member and the operated member, and performs the unlock operation via a release member connected to the other one of the operating member and the operated member.

5. A door lock apparatus for a vehicle according to claim 4, wherein the operated member is rotatably supported on the shaft including a first lever portion, a second lever portion and a third lever portion which is in contact with the restricting member when the operating member is moved to the first position side.

6. A door lock apparatus for a vehicle according to claim 4, wherein the closure member is rotatably connected to an edge portion of the operating member and includes an operating pin substantially extending parallel to the shaft.

7. A door lock apparatus for a vehicle according to claim 6, wherein the operating pin is pushed toward a guide face formed on the housing via a coil spring disposed between the closure member and the operating member.

8. A door lock apparatus for a vehicle according to claim 7, wherein the release member is rotatably connected to an edge portion of the second lever portion of the operated member and includes a base portion, a middle portion formed with a guide hole into which a control pin provided on the housing is positioned, and an operating portion.

9. A door lock apparatus for a vehicle according to claim 8, wherein the operating portion of the release member rotates a restricting a rotation of the latch to be disengaged from the latch.

10. A door lock apparatus for a vehicle according to claim 1, wherein the detecting means is a single switch.

11. A door lock apparatus for a vehicle comprising:

a latch provided at one of a vehicle door and a vehicle-body and being rotatable between an open position in which the latch is disengageable from a striker provided at the other one of the vehicle door and the vehicle-body and a lock position in which the latch is prohibited to disengage from the striker;

an operating member for performing one of a lock operation for rotating the latch to the lock position and an unlock operation for rotating the latch to the open position, the operating member performing the lock operation by being moved from a neutral position to a first position by a driving source, and performing the unlock operation by being moved from the neutral position to a second position opposite to the first position relative to the neutral position by the driving source;

a control unit for switching a moving direction of the operating member driven by the driving source so that the operating member alternately performs the lock operation and the unlock operation;

an operated member for being operated along with the operating member moved to the second position;

the operating member being rotated by the driving source with respect to a shaft and performing the lock operation via a closure member connected to one of the operating member and the operated member, and performing the unlock operation via a release member connected to the other one of the operating member and the operated member;

the operated member being rotatably supported on the shaft including a first lever portion, a second lever portion and a third lever portion which is in contact with the restricting member when the operating member is moved to the first position side;

a restricting member for restricting a movement of the operated member in a predetermined position when the operating member is moved to the first position;

a detecting means for detecting the operated member being positioned adjacent to the predetermined position;

the detecting means including a switch that is turned in ON status by a pressing operation of the operated member approaching the neutral position from the second position and turned in OFF status by a cancellation of the pressing operation of the operated member moving away from the neutral position to the second position;

a biasing member for constantly biasing the operated member from the second position side to the restricting member side; and wherein the control unit enters a standby mode through a process of bringing the operating member to return to the second position side after one of the lock operation and the unlock operation is completed so that the operated member is not detected by the detecting means, and enters the standby mode through a process of bringing the operating member to return to the first position side after the other one of the lock operation and the unlock operation is completed so that the operated member is detected by the detecting means.

12. A door lock apparatus for a vehicle comprising:

a latch provided at one of a vehicle door and a vehicle-body and being rotatable between an open position in which the latch is disengageable from a striker provided at the other one of the vehicle door and the vehicle-body and a lock position in which the latch is prohibited to disengage from the striker;

an operating member for performing one of a lock operation for rotating the latch to the lock position and an unlock operation for rotating the latch to the open position, the operating member performing the lock operation by being moved from a neutral position to a first position by a driving source, and performing the unlock operation by being moved from the neutral position to a second position opposite to the first position relative to the neutral position by the driving source;

a control unit for switching a moving direction of the operating member driven by the driving source so that the operating member alternately performs the lock operation and the unlock operation;

an operated member for being operated along with the operating member moved to the second position;

the operating member being rotated by the driving source with respect to a shaft and performing the lock operation via a closure member connected to one of the operating member and the operated member, and performing the unlock operation via a release member connected to the other one of the operating member and the operated member;

the closure member being rotatably connected to an edge portion of the operating member and including an operating pin substantially extending parallel to the shaft;

a restricting member for restricting a movement of the operated member in a predetermined position when the operating member is moved to the first position;

a detecting means for detecting the operated member being positioned adjacent to the predetermined position;

the detecting means including a switch that is turned in ON status by a pressing operation of the operated member approaching the neutral position from the second position and turned in OFF status by a cancellation of the pressing operation of the operated member moving away from the neutral position to the second position;

a biasing member for constantly biasing the operated member from the second position side to the restricting member side; and wherein the control unit enters a standby mode through a process of bringing the operating member to return to the second position side after one of the lock operation and the unlock operation is completed so that the operated member is not detected by the detecting means, and enters the standby mode through a process of bringing the operating member to return to the first position side after the other one of the lock operation and the unlock operation is completed so that the operated member is detected by the detecting means.

13. A door lock apparatus for a vehicle according to claim 12, wherein the operating pin is pushed toward a guide face formed on the housing via a coil spring disposed between the closure member and the operating member.

14. A door lock apparatus for a vehicle according to claim 13, wherein the release member is rotatably connected to an edge portion of the second lever portion of the operated member and includes a base portion, a middle portion formed with a guide hole into which a control pin provided on the housing is positioned, and an operating portion.

15. A door lock apparatus for a vehicle according to claim 14, wherein the operating portion of the release member rotates a pawl restricting a rotation of the latch to be disengaged from the latch.

* * * * *